US008796948B2

(12) United States Patent
Weaver et al.

(10) Patent No.: US 8,796,948 B2
(45) Date of Patent: Aug. 5, 2014

(54) LAMP COLOR MATCHING AND CONTROL SYSTEMS AND METHODS

(75) Inventors: Matthew Weaver, Scotts Valley, CA (US); Juergen Gsoedl, Dublin, CA (US)

(73) Assignee: Lumenetix, Inc., Scotts Valley, CA (US)

( * ) Notice: Subject to any disclaimer, the term of this patent is extended or adjusted under 35 U.S.C. 154(b) by 934 days.

(21) Appl. No.: 12/782,038

(22) Filed: May 18, 2010

(65) Prior Publication Data

US 2011/0109445 A1 May 12, 2011

Related U.S. Application Data

(60) Provisional application No. 61/259,914, filed on Nov. 10, 2009.

(51) Int. Cl.
*H05B 37/00* (2006.01)
*H05B 37/02* (2006.01)

(52) U.S. Cl.
CPC ..... *H05B 37/0272* (2013.01)
USPC ..... 315/294; 315/308; 315/312

(58) Field of Classification Search
USPC ..... 315/152, 158, 185 R, 291, 294, 307, 315/308, 312
See application file for complete search history.

(56) References Cited

U.S. PATENT DOCUMENTS 5,099,348 A 3/1992 Huddleston et al.
5,109,222 A 4/1992 Welty
5,457,478 A 10/1995 Frank
6,128,117 A 10/2000 Kim
6,411,046 B1 6/2002 Muthu
6,799,864 B2 10/2004 Bohler et al.
7,423,387 B2 * 9/2008 Robinson et al. ..... 315/291
7,575,339 B2 8/2009 Hung
8,294,374 B2 10/2012 Colak et al.
8,442,403 B2 5/2013 Weaver
8,485,687 B2 7/2013 McQuistian et al.

(Continued)

FOREIGN PATENT DOCUMENTS

JP 2005-011628 A 1/2005
JP 2006-059605 A 3/2006

(Continued)

OTHER PUBLICATIONS

Co-Pending U.S. Appl. No. 13/367,187 of Weaver, M.D., filed Feb. 6, 2012.

(Continued)

*Primary Examiner* — Jimmy Vu
(74) *Attorney, Agent, or Firm* — Perkins Coie LLP

(57) ABSTRACT

Lamp color matching and control systems and methods are described. One embodiment includes a lighting node and a controller. The lighting node can include a plurality of light emitting diodes configured for illumination and further configured for optical communication with the controller, a communicator configured for radio communication with the controller, a memory configured to store a node identifier, a control logic, and a temperature sensor. The controller can include an optical sensor configured to sense the correlated color temperature and brightness of the lighting node and further configured for optical communication with the lighting node, and a communicator configured for radio communication with the lighting node. The controller can calibrate the lighting node as well as perform light copy and paste, light following, and light harvesting operations with the lighting node.

18 Claims, 13 Drawing Sheets

(56) References Cited

U.S. PATENT DOCUMENTS

| | | | | |
|---|---|---|---|---|
| 8,594,505 | B2 | 11/2013 | Weaver | |
| 2002/0097000 | A1 | 7/2002 | Muthu et al. | |
| 2002/0114155 | A1 | 8/2002 | Katogi et al. | |
| 2004/0008992 | A1 | 1/2004 | Nishimura | |
| 2004/0105264 | A1 | 6/2004 | Spero | |
| 2005/0030744 | A1 | 2/2005 | Ducharme et al. | |
| 2005/0047134 | A1 | 3/2005 | Mueller et al. | |
| 2005/0128751 | A1 | 6/2005 | Roberge et al. | |
| 2005/0265029 | A1 | 12/2005 | Epstein et al. | |
| 2007/0183163 | A1 | 8/2007 | Daniel | |
| 2007/0248047 | A1 | 10/2007 | Shorty et al. | |
| 2008/0062682 | A1 | 3/2008 | Hoelen et al. | |
| 2008/0191631 | A1* | 8/2008 | Archenhold et al. | 315/158 |
| 2009/0040750 | A1 | 2/2009 | Myer | |
| 2009/0152576 | A1 | 6/2009 | Naum et al. | |
| 2009/0184648 | A1 | 7/2009 | Colak et al. | |
| 2009/0218951 | A1 | 9/2009 | Weaver | |
| 2009/0267524 | A1 | 10/2009 | Draaijer et al. | |
| 2010/0110672 | A1* | 5/2010 | Durand et al. | 362/231 |
| 2010/0188004 | A1 | 7/2010 | Baggen et al. | |
| 2010/0231363 | A1 | 9/2010 | Knibbe | |
| 2010/0244746 | A1 | 9/2010 | Van De Sluis et al. | |
| 2010/0301776 | A1 | 12/2010 | Feri et al. | |
| 2011/0037409 | A1 | 2/2011 | Van De Ven et al. | |
| 2011/0044701 | A1 | 2/2011 | Schenk et al. | |

FOREIGN PATENT DOCUMENTS

| | | | |
|---|---|---|---|
| WO | WO-02/13490 | A2 | 2/2002 |
| WO | WO-02/47438 | A2 | 6/2002 |
| WO | WO-02/082283 | A2 | 10/2002 |
| WO | WO-02/082863 | A1 | 10/2002 |
| WO | WO-03/055273 | A2 | 7/2003 |
| WO | WO-2004/057927 | A1 | 7/2004 |
| WO | WO-2006/111934 | A1 | 10/2006 |
| WO | WO-2007/125477 | A2 | 11/2007 |

OTHER PUBLICATIONS

Co-Pending U.S. Appl. No. 13/627,926 of Weaver, M.D., filed Sep. 26, 2012.
Co-Pending U.S. Appl. No. 13/655,679 of Weaver, M.D., filed Oct. 19, 2012.
Co-Pending U.S. Appl. No. 13/655,738 of Weaver, M.D., filed Oct. 19, 2012.
Co-Pending U.S. Appl. No. 13/766,695 of Bowers, D. et al., filed Feb. 13, 2013.
Co-Pending U.S. Appl. No. 13/766,707 of Bowers, D., filed Feb. 13, 2013.
Co-Pending U.S. Appl. No. 13/766,745 of Bowers, D. et al., filed Feb. 13, 2013.
Co-Pending U.S. Appl. No. 13/770,595 of Weaver, M.D., filed Feb. 19, 2013.
Co-Pending U.S. Appl. No. 13/848,628 of Weaver, M.D., filed Mar. 21, 2013.
Non-Final Office Action Mailed Sep. 23, 2011 in Co-Pending U.S. Appl. No. 12/396,399 of Weaver, M.D., filed Mar. 2, 2009.
Final Office Action Mailed Dec. 5, 2012 in Co-Pending U.S. Appl. No. 12/396,399 of Weaver, M.D., filed Mar. 2, 2009.
Non-Final Office Action Mailed Jan. 4, 2013 in Co-Pending U.S. Appl. No. 12/396,399 of Weaver, M.D., filed Mar. 2, 2009.
Notice of Allowance Mailed Mar. 20, 2013 in Co-Pending U.S. Appl. No. 12/396,399 of Weaver, M.D., filed Mar. 2, 2009.
Non-Final Office Action Mailed Dec. 4, 2012 in Co-Pending U.S. Appl. No. 13/627,926 Weaver, M.D., filed Sep. 26, 2012.
Non-Final Office Action Mailed Feb. 28, 2013 in Co-Pending U.S. Appl. No. 13/655,738 Weaver, M.D., filed Oct. 19, 2010.
International Search Report mailed Dec. 28, 2010, for International Patent Application No. PCT/2010/035295 filed May 18, 2010, pp. 1-8.
Written Opinion mailed Dec. 28, 2010, for International Patent Application No. PCT/2010/035295 filed May 18, 2010, pp. 1-5.
Non-Final Office Action Mailed Mar. 11, 2014, in Co-Pending U.S. Appl. No. 13/627,926 by Weaver, M.D., filed Oct. 19, 2012.
Non-Final Offfice Action Mailed Aug. 5, 2013 in Co-Pending U.S. Appl. No. 13/367,187 by Weaver, M.D., filed Feb. 6, 2012.
Final Office Action Mailed Jan. 16, 2014, in Co-Pending U.S. Appl. No. 13/367,187 by Weaver, M.D., filed Feb. 6, 2012.
Non-Final Office Action Mailed May 9, 2014, in Co-Pending U.S. Appl. No. 13/367,187 by Weaver, M.D., filed Feb. 6, 2012.
Notice of Allowance Mailed Mar. 14, 2014, in Co-Pending U.S. Appl. No. 13/655,738 by Weaver, M.D., filed Oct. 19, 2012.
Co-pending U.S. Appl. No. 12/396,399, filed Mar. 2, 2009.

* cited by examiner

LAMP COLOR MATCHING AND CONTROL SYSTEMS AND METHODS

CLAIM OF PRIORITY

This application claims priority to U.S. Provisional Patent Application No. 61/259,914 entitled "Optical Addressing and Color Matching," which was filed on Nov. 10, 2009 by Matthew Weaver and Juergen Gsoedl, the contents of which are expressly incorporated by reference herein.

BACKGROUND

Conventional systems for controlling lighting in homes and other buildings suffer from many drawbacks. One such drawback is that these systems rely on conventional lighting technologies, such as incandescent bulbs and fluorescent bulbs. Such light sources are limited in many respects. For example, such light sources typically do not offer long life or high energy efficiency. Further, such light sources offer only a limited selection of colors, and the color or light output of such light sources typically changes or degrades over time as the bulb ages. In systems that do not rely on conventional lighting technologies, such as systems that rely on light emitting diodes ("LEDs"), long system lives are possible and high energy efficiency can be achieved. However, in such systems issues with color quality can still exist.

A light source can be characterized by its color temperature and by its color rendering index ("CRI"). The color temperature of a light source is the temperature at which the color of light emitted from a heated black-body radiator is matched by the color of the light source. For a light source which does not substantially emulate a black body radiator, such as a fluorescent bulb or an LED, the correlated color temperature ("CCT") of the light source is the temperature at which the color of light emitted from a heated black-body radiator is approximated by the color of the light source. The CRI of a light source is a measure of the ability of a light source to reproduce the colors of various objects faithfully in comparison with an ideal or natural light source. The CCT and CRI of LED light sources is typically difficult to tune and adjust. Further difficulty arises when trying to maintain an acceptable CRI while varying the CCT of an LED light source.

The foregoing examples of the related art and limitations related therewith are intended to be illustrative and not exclusive. Other limitations of the related art will become apparent upon a reading of the specification and a study of the drawings.

SUMMARY

Lamp color matching and control systems and methods are described. One embodiment includes a lighting node and a controller. The lighting node can include a plurality of light emitting diodes configured for illumination and further configured for optical communication with the controller, a communicator configured for radio communication with the controller, a memory configured to store a node identifier, a control logic, and a temperature sensor. The controller can include an optical sensor configured to sense the correlated color temperature and brightness of the lighting node and further configured for optical communication with the lighting node, and a communicator configured for radio communication with the lighting node. The controller can calibrate the lighting node as well as perform light copy and paste, light following, and light harvesting operations with the lighting node.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Described in detail below are lighting and control systems and methods.

Various aspects of the invention will now be described. The following description provides specific details for a thorough understanding and enabling description of these examples. One skilled in the art will understand, however, that the invention can be practiced without many of these details. Additionally, some well-known structures or functions are not shown or described in detail, so as to avoid unnecessarily obscuring the relevant description. Although the diagrams depict components as functionally separate, such depiction is merely for illustrative purposes. It will be apparent to those skilled in the art that the components portrayed in this figure can be arbitrarily combined or divided into separate components.

The terminology used in the description presented below is intended to be interpreted in its broadest reasonable manner, even though it is being used in conjunction with a detailed description of certain specific examples of the invention. Certain terms can even be emphasized below; however, any terminology intended to be interpreted in any restricted manner will be overtly and specifically defined as such in this Detailed Description section.

A. A Lighting Node

Figure 1:
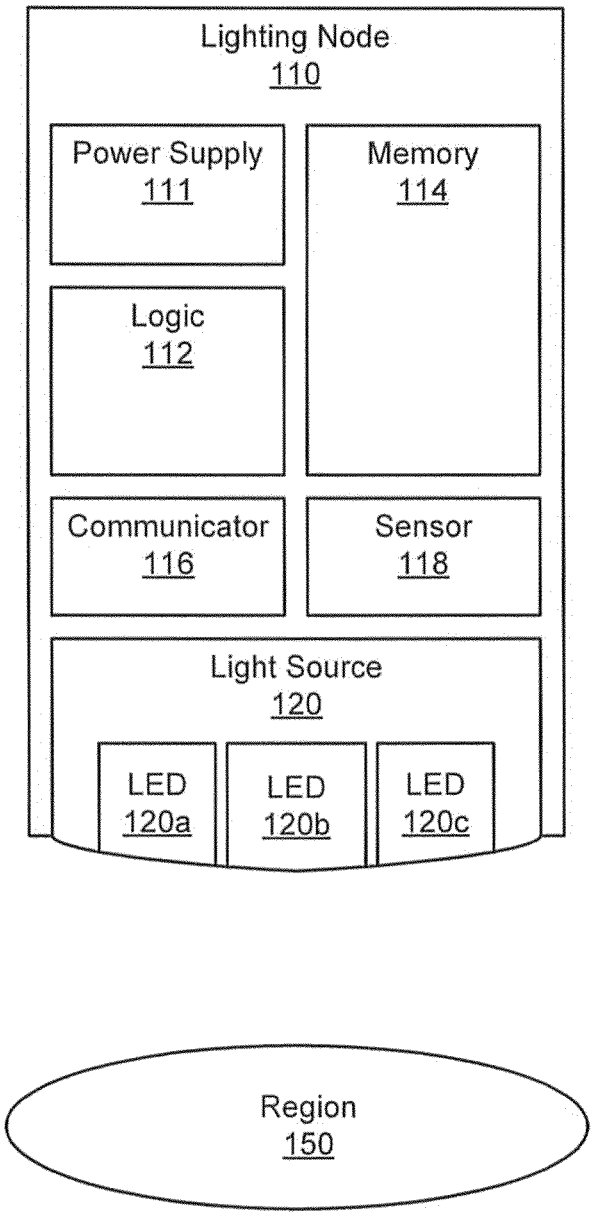
FIG. 1 depicts a block diagram of a lighting node and a region.

FIG. 1 depicts a block diagram of lighting node 110 according to one embodiment of the invention. Lighting node 110 comprises power supply 111, logic 112, memory 114, communicator 116, sensor 118, and light source 120. Lighting node 110 can provide a highly configurable and precise lighting experience with adjustable correlated color temperatures ("CCT") and an optimized color rendering index ("CRI"), as discussed in detail below.

Lighting node 110 includes light source 120, which in one embodiment includes a group of light emitting diodes ("LEDs"), depicted as LED 120*a*, LED 120*b*, and LED 120*c*. Each of LED 120*a*, 120*b*, and 120*c* includes one or more LEDs. For example, in one embodiment, LED 120*a* includes a subgroup, or "string," of LEDs, while LED 120*b* includes a single LED. The LEDs of light source 120 can be configured to emit light of a single color or of a uniform spectrum, or alternatively several of the LEDs can be configured to emit light of varying colors, or having different spectrums, as discussed further below. Notably, in some embodiments light source 120 includes light sources other than LEDs that are still amenable to CCT and CRI control according to the techniques introduced here.

Light source 120 is configured to illuminate a region, such as region 150. Light from each of LED 120*a*, 120*b*, and 120*c* is emitted from lighting node 110 in, for example, a diffuse manner so as to uniformly mix and illuminate region 150.

Lighting node 110 also includes communicator 116, which in various embodiments includes different kinds of wireless devices. For example, in some embodiments communicator 116 is a radio receiver for receiving radio transmissions, while in other embodiments communicator 116 is a radio transceiver for sending and receiving radio transmissions. Further, communicator 116 can operate as, for example, an analog or digital radio, a packet-based radio, an 802.11-standard radio, a Bluetooth radio, or a wireless mesh network radio. Further still, in some embodiments communicator 116 can be implemented to operate as a wireline device, such as a communication-over-powerline device, a USB device, or an Ethernet device.

Lighting node 110 also includes memory 114, which in various embodiments includes different kinds of memory devices. For example, in some embodiments memory 114 is a volatile memory, while in other embodiments memory 114 is a nonvolatile memory. Memory 114 can be implemented as, for example, a random access memory, a sequential access memory, a FLASH memory, or a hard drive, for example. Memory 114 can be configured to store a color mixing plan and LED models for light source 120. Further, memory 114 can be configured to store an identifier for lighting node 110, such as a serial number or a Media Access Control ("MAC") address.

Lighting node 110 also includes power supply 111, which in various embodiments includes different kinds of power supply hardware. For example, in some embodiments power supply 111 is a battery power supply, while in other embodiments power supply 111 is coupled to an external power supply. In embodiments wherein power supply 111 is coupled to an external power supply, power supply 111 can include a transformer or other power conditioning device. Power supply 111 provides energy to other components of lighting node 110.

Lighting node 110 also includes logic 112. Logic 112 is configured, in one embodiment, as a processor for executing software to control the operation of other components of lighting node 110. Logic 112 can also be configured as, for example, an hardware controller, an ASIC, or another logic circuit configured according to the techniques introduced here.

B. Setting up a Lighting Node

Figure 2A:
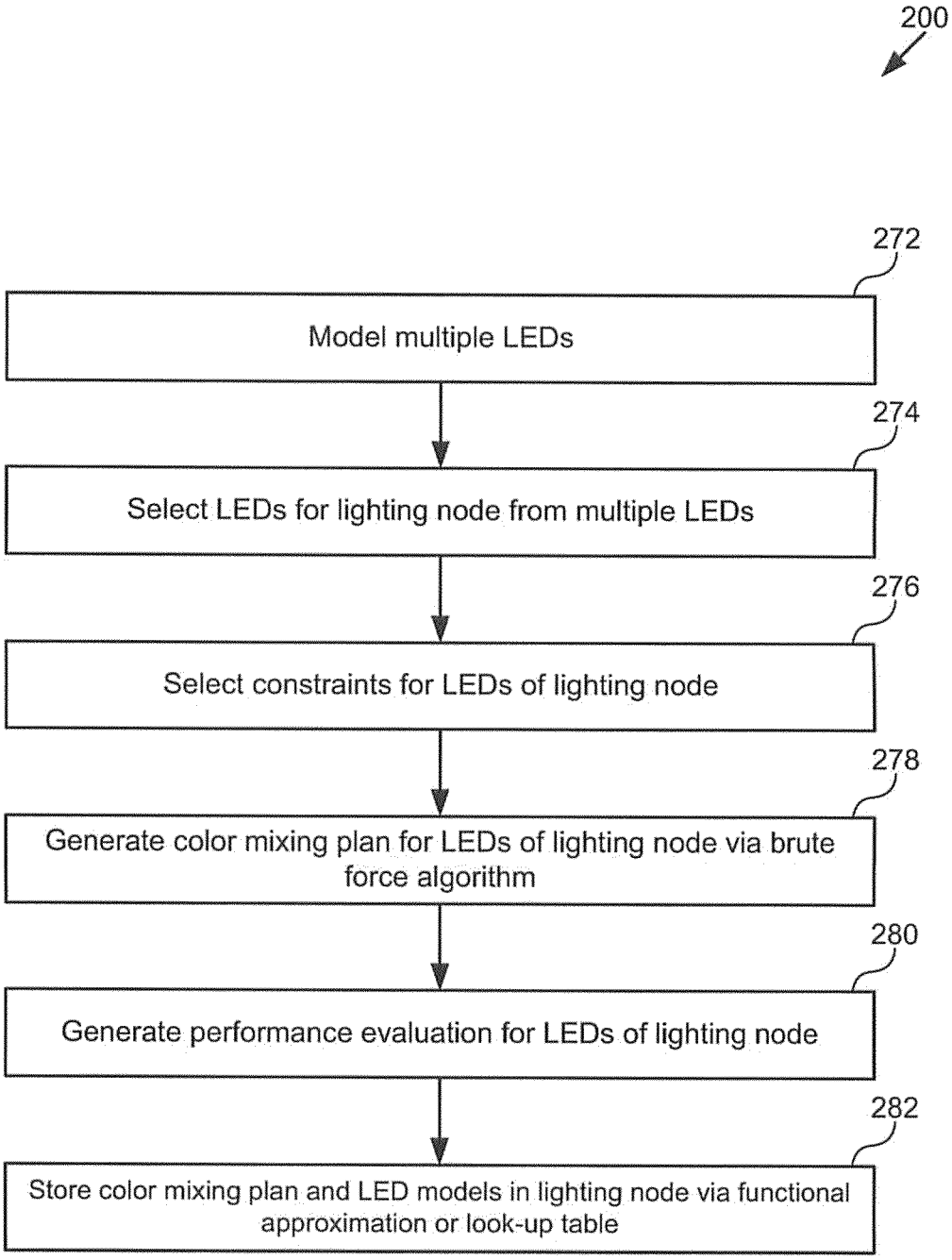
FIG. 2*a* depicts a flowchart of a method for setting up a lighting node.

FIG. 2*a* depicts flowchart 200 of a method for setting up a lighting node, such as lighting node 110 depicted in FIG. 1. Setting up a lighting node involves steps 272 through 282 depicted in FIG. 2*a*, which according to the techniques introduced here accomplish several goals. First, after setting up a lighting node according to flowchart 200, the lighting node will have adjustable CCTs so that it may be adjusted between, for example, different "white" levels. Further, during such adjustment the lighting node will maintain, maximize, or optimize its CRI.

Flowchart 200 begins with step 272, in which multiple LEDs are modeled. This discussion will involve the modeling of LEDs, but in other embodiments, the lighting node being set up can include light sources other than LEDs. Modeling LEDs includes gathering manufacturer data sheets that specify LED performance data under specific conditions, and developing functional approximations of LED performance by, for example, fitting to the performance data using a least mean squares method. In this way, gaps in published LED performance data can be filled. Further, new relationships between LED performance variables can be developed. For example, a function for the current required to generate a desired luminous flux from an LED operating at a given temperature can be developed.

In step 274, LEDs for the lighting node can be selected from the modeled LEDs. To create a lighting node that can produce a particular CCT, several different colors may be selected. For example, a white LED, a red LED, an amber LED, and a green LED can be selected. Further, in one embodiment, multiple LEDs of a particular color can be grouped in LED 120*a*, LED 120*b*, and LED 120*c*. Thus, LED 120*a* might have one white LED, LED 120*b* might have two red LEDs, and LED 120*c* might have two green LEDs, for example. The number of LEDs selected will affect the total brightness of the lighting node. Notably, typically many sub-colors are available from LED manufacturers that sort LEDs based on minor variation in colors. Manufacturers may describe such sorting with LED BIN codes, for example. In one embodiment, multiple LEDs of different sub-colors can be included in one group (e.g. in LED 120*a*); any potentially deleterious effect of the variations in colors can be eliminated in subsequent lighting node performance evaluation.

In step 276, constraints for the LEDs of the lighting node are selected. Constraints can include, for example, constraints on the electrical or physical properties of the lighting node, such as the total luminous flux, the total luminous efficacy, the total luminous efficiency, and the maximum operating temperature. Further, constraints can include constraints on the color properties of the lighting node, such as constraints on the CCT, the CRI, the color difference (e.g., as defined in CIEDE 2000), the delta-UV (e.g., as defined in CIE 1961), or the xy color coordinate.

In step 278, a color mixing plan is generated for the LEDs of the lighting node using, in one embodiment, a brute force algorithm. The color mixing plan specifies the luminous flux required from all LEDs in a lighting node to achieve a desired CCT, while maintaining or optimizing a desirable CRI. One brute force algorithm can operate by, for example, selecting a total luminous flux of 1000 lumens, and then by stepping through possible combinations of luminous flux for each LED in the lighting node while maintaining the total luminous flux. Thus, for example, LED 120*a* may be set to output 990 lumens, LED 120*b* may be set to output 5 lumens, and LED 120*c* may be set to output 5 lumens, and the CCT and the CRI of the lighting node can be measured. Continuing the brute force algorithm, LED 120*a* may be set to output 985 lumens, LED 120*b* may be set to output 10 lumens, and LED 120*c* may be set to output 5 lumens, and the CCT and the CRI of the lighting node can be measured again.

Notably, in this example a step size of 5 lumens has been used, but in other embodiments a different step size can be selected. Larger step sizes can be used when results vary slowly. It is also the case that it is often not necessary to try combinations near end points, such as where the white LED flux is less than 30% of the total output or more than 90% of the total output. Thus, in an embodiment where total luminous flux is set at 1000, then a white LED 120*a* may be initially set to output 900 lumens, rather than 990 lumens as discussed above. Further, in the same embodiment the brute force stepping can be terminated at, for example, a white LED 120*a* output of 300 lumens, without further dimming. The brute force algorithm may be made-further manageable by avoiding combinations that drive the total light output away from the Planck locus. As is known in the art, the Planck locus (i.e. the Plankian locus) is a line or region in a chromaticity diagram away from which a CCT measurement ceases to be meaningful. Thus, for example, a combination which has too much red output, thereby driving the output of the entire lighting node away from the Plank locus, can be avoided.

Figure 2B:
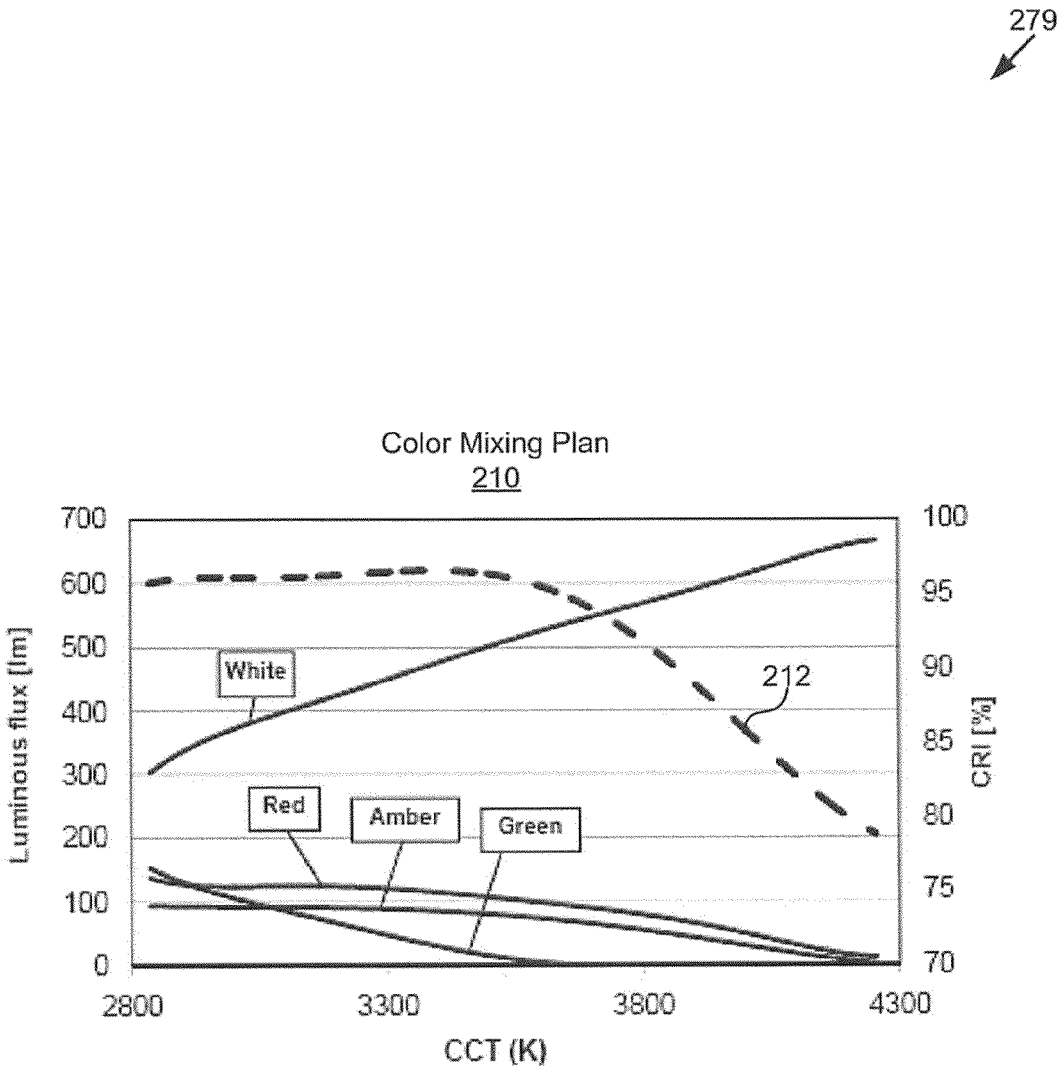
FIG. 2*b* depicts a color mixing plan including an optimized CRI.

FIG. 2*b* depicts illustrative color mixing plan 210 as generated in one embodiment by step 278. Color mixing plan 210 depicts the luminous flux (in lumens) of a white LED, a red LED, an amber LED, and a green LED for various increasing CCTs (in Kelvins). The increasing output of the white LED, and the decreasing outputs of the red, amber, and green LEDs, with increasing CCT have been generated by the brute force algorithm to maximize the CRI, depicted in dashed line 212. Notably, at a given CCT, other valid combinations of white, red, amber, and green output exist, but the combination depicted in color mixing plan 210 actually achieves the optimum CRI at line 212.

Values in color mixing plan 210 can be calculated in several ways. For example, the CCT in color mixing plan 210 can be calculated by additive color mixing with CIE chromaticity coordinates, wherein the CCT is the weighted average of the CIE chromaticity coordinates of each LED using luminous flux as the weighting factor. Alternatively, the CCT can be calculated by spectral color mixing using spectral power distributions of LEDs, wherein the combined spectral power distribution, from which the CCT can be computed, is the weighted average of the spectral power distributions of each LED using luminous flux as the weighting factor.

Figure 2C:
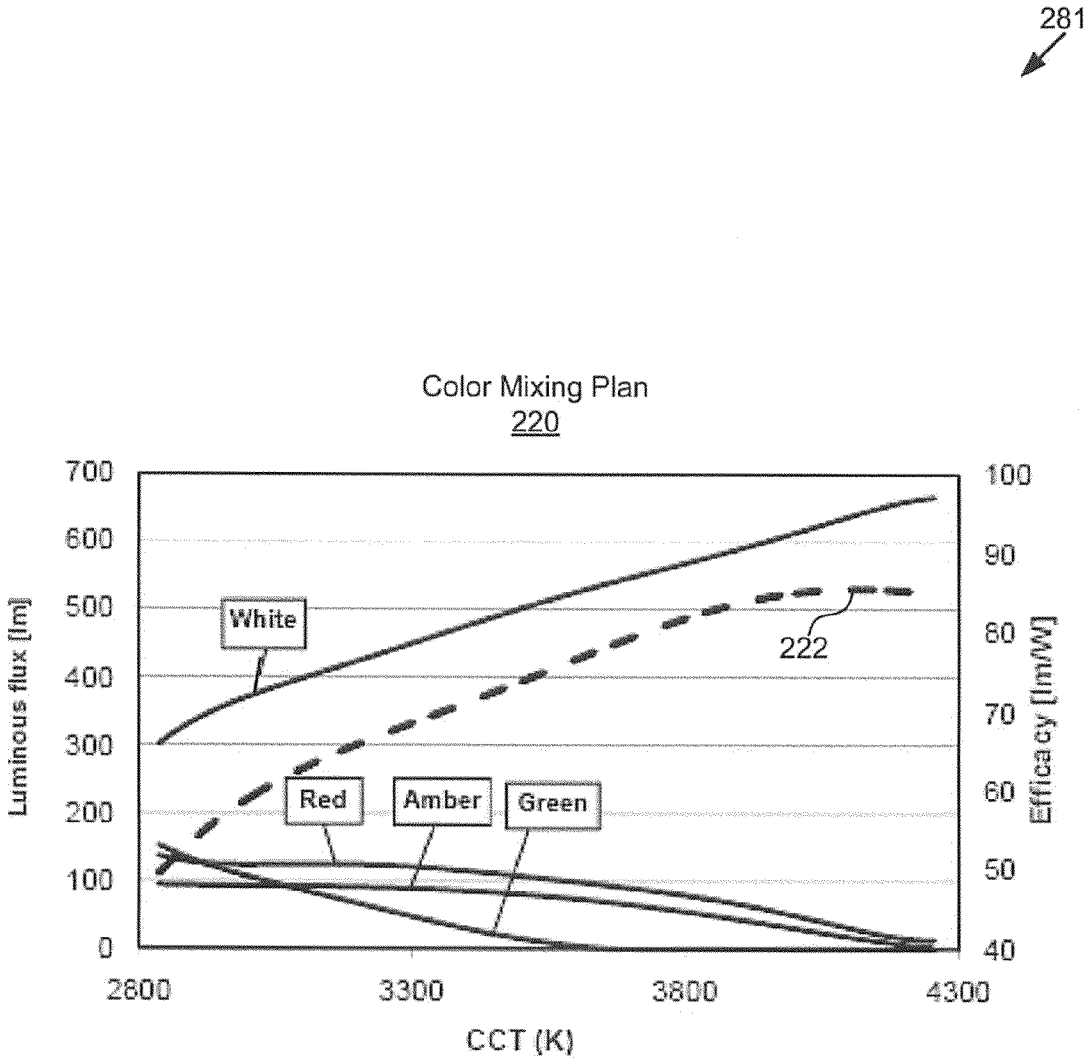
FIG. 2*c* depicts a color mixing plan including luminous efficacy.

Considering again FIG. 2*a*, in step 280 a performance evaluation can be generated for LEDs of the lighting node. Generally, the CRI, luminous efficacy, luminous efficiency, color difference, delta-UV, or other parameters can be evaluated against CCT. For example, FIG. 2*c* shows color mixing plan 220 evaluating the luminous efficacy, at dashed line 222, for a particular set of luminous outputs of white, red, amber, and green LEDs.

In step 282, a color mixing plan is stored in a lighting node, such as lighting node 110. In particular, the color mixing plan can be received by communicator 116 and stored in memory 114. The color mixing plan may be stored as, for example, a look-up table of points on the curves of luminous flux versus CCT, or as, for example, a functional approximation set of coefficients. Notably, in one embodiment the storage of a look-up table is memory intensive, and in another embodiment the storage of coefficients is processor- or logic-intensive. In the latter case, logic 112 can be utilized to calculate polynomial results based on stored coefficients. Further in step 282, the LED models created in step 272 can also be stored in lighting node 110, for subsequent use during operation as discussed below.

C. Operating a Lighting Node

Figure 3:
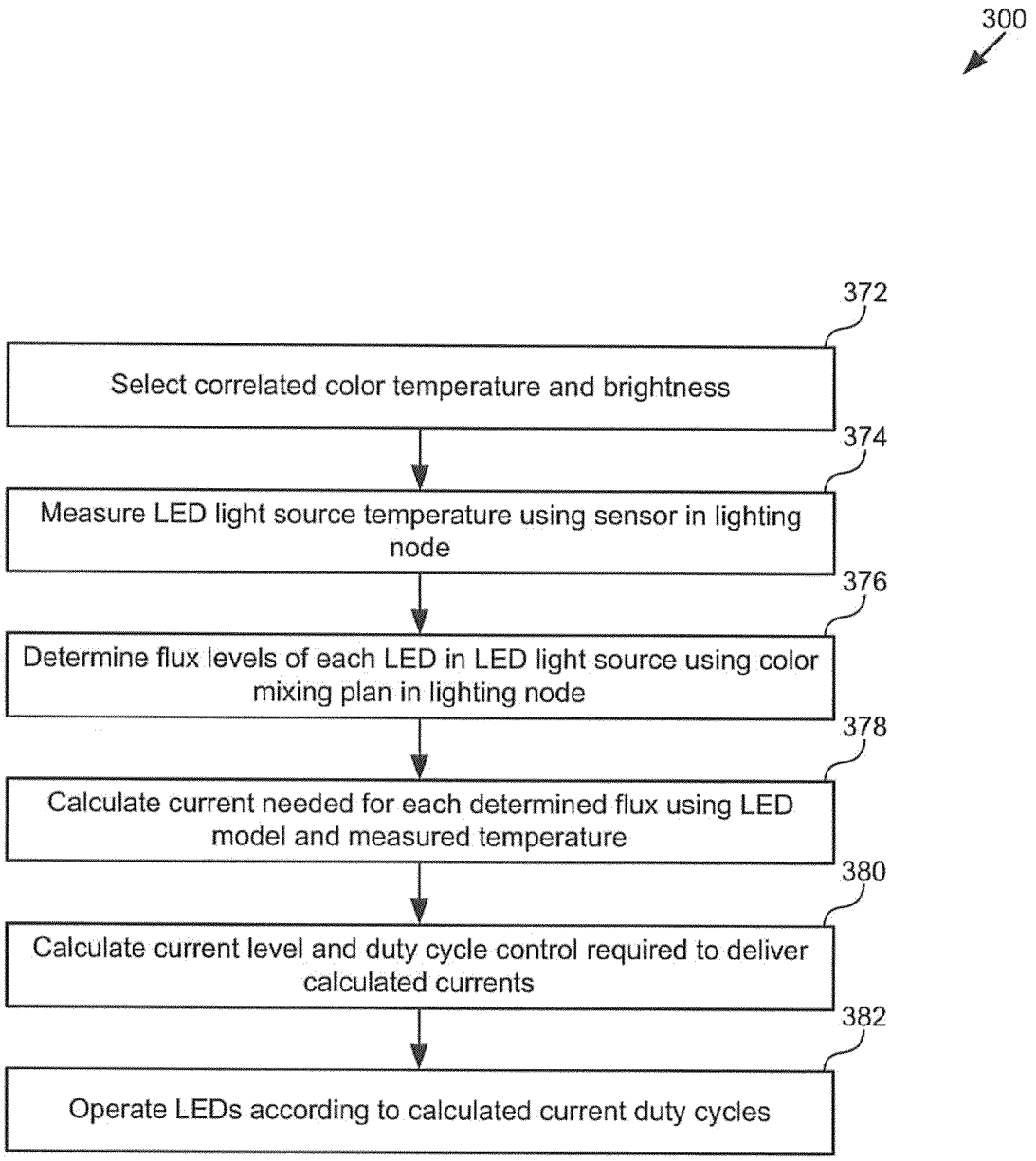
FIG. 3 depicts a flowchart of a method for operating a lighting node.

FIG. 3 depicts flowchart 300, beginning with step 372, in which a CCT and brightness setting are received at a lighting node, such as lighting node 110. The CCT and brightness setting can be received from, for example, a lighting node controller as discussed further below. The CCT and brightness settings can be stored in memory 114, where a color mixing plan and relevant LED models are also stored, as discussed above.

In step 374, the temperature of light source 120 is measured by sensor 118. As such, sensor 118 includes a temperature sensor coupled with light source 120. In one embodiment, light source 120*a*, 120*b*, and 120*c* are independently sensed by sensor 118 for improved temperature resolution within light source 120. The sensed temperature or temperatures can be stored in memory 114 or provided to logic 112.

In step 376, the flux levels of each LED in light source 120 are determined using the color mixing plan stored in memory 114. This determination can be based on, for example, using the CCT received in step 372 to look up flux levels in a look-up table stored in memory 114. Alternatively, for example, this determination can be based on, for example, using the brightness received in step 372 to calculate flux levels in logic 112 based on coefficients looked up in memory 114.

In step 378, the currents needed for the flux levels determined in step 376 are calculated for each LED in light source 120. The currents can be calculated based on, for example, the temperature measured in step 374 and the LED models stored in memory 114. In particular, it might be the case that at a given temperature, LEDs in LED 120*a*, for example, have different flux level characteristics than LEDs in LED 120*b*. Such behaviors were calculated, in one embodiment, during LED modeling as discussed above.

In step 380, the duty cycles, or current level and duty cycle control, required to deliver current to the LEDs of light source 120 are calculated. In an illustrative embodiment, power supply 111 is configured to provide power to LEDs 120*a*, 120*b*, and 120*c* at varying duty cycles to independently control brightness and CCT. As such, lighting node 110 can calculate currents needed for flux in step 378, above, and then calculate duty cycles in step 380 for brightness, for example.

In step 382, the LEDs of lighting node 110 are operated according to the calculated duty cycles, and lighting node 110 illuminates according to the received CCT and brightness of step 372. Notably, in one embodiment lighting node 110 can periodically repeat steps 374 through 382, in order to update its operational parameters based on changing temperature conditions. For example, lighting node 110 might rapidly increase in temperature when operated after a long period of inactivity. As such, multiple iterations of steps 374 through 382 may be required to maintain a set CCT, or brightness, or both. Similarly, lighting node 110 might slowly decrease in temperature during operation if the environmental temperature decreases, such as with the onset of nighttime. As such, multiple iterations may similarly be required. Further, lighting node 110 in one embodiment is configured to reduce the luminous flux of light source 120 if the temperature equals or exceeds a maximum operating temperature specified in the color mixing plan.

Figure 4A:
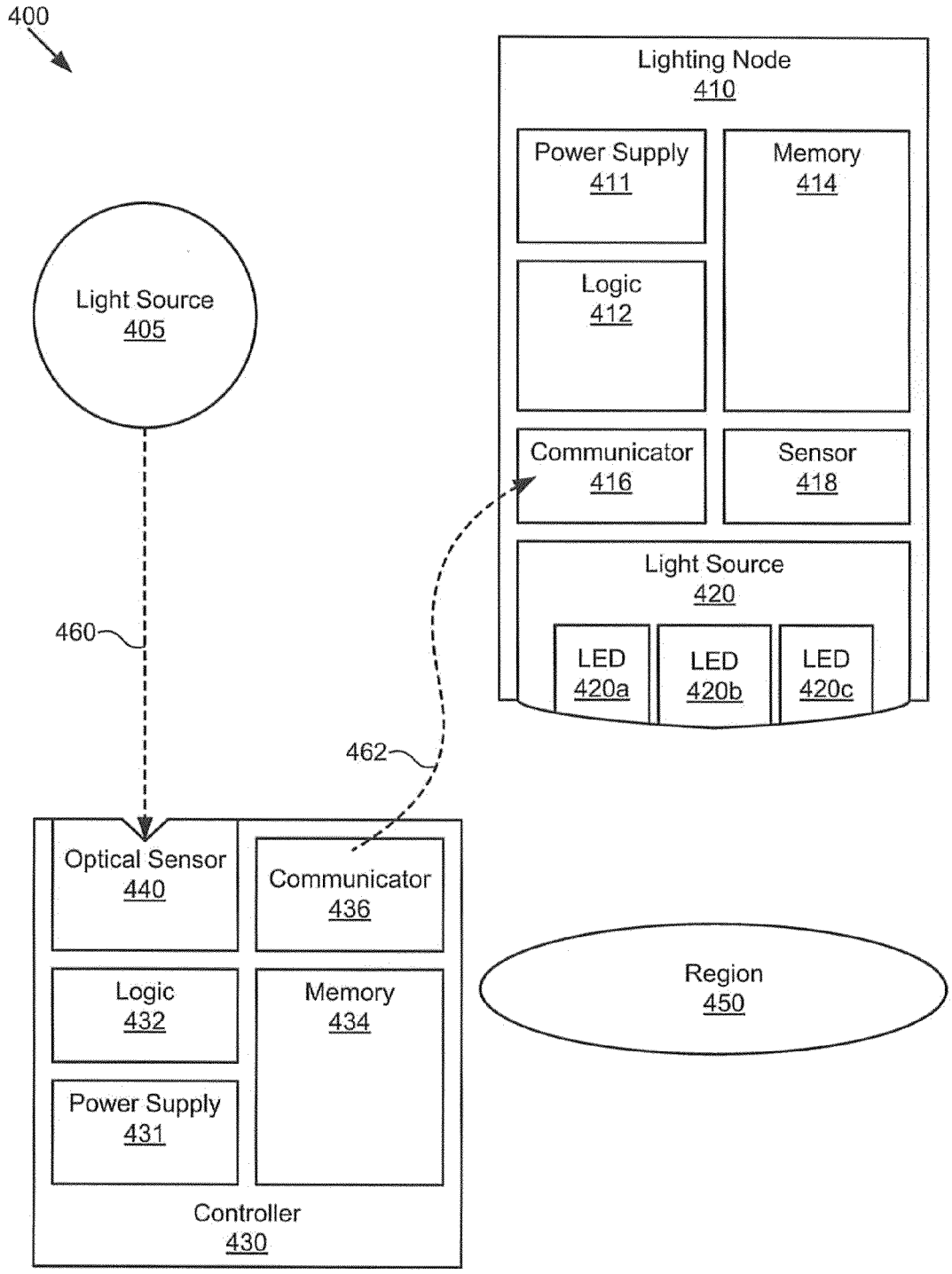
FIG. 4*a* depicts a block diagram of a light source, a lighting node, a controller, and a region.

FIG. 4*a* depicts a block diagram of system 400 according to one embodiment of the invention. System 400 includes lighting node 410, controller 430, light source 405, and region 450. Lighting node 410 substantially corresponds, in one embodiment, to lighting node 110 depicted in FIG. 1. Light source 405 can be a natural or artificial light source emitting light in system 400. Region 450 is a region which can be illuminated by lighting node 410. Controller 430 is a controller for lighting node 410 that includes optical sensor 440, communicator 436, logic 432, and memory 434.

Optical sensor 440 of controller 430 is configured to sense illumination provided by a light source. More specifically, optical sensor 440 can be configured to sense characteristics of the illumination such as brightness, spectrum, CCT, or CRI, for example. Further, optical sensor 440 is configured in one embodiment to receive optical communication from a light source of lighting node 410. Optical sensor 440 can be implemented to include, for example, a photodetector, a photodiode, a photomultiplier, a charge-coupled device ("CCD") camera, or another type of optical sensor. Further, optical sensor 440 can be implemented as one optical sensor or an array of optical sensors. In one embodiment, optical sensor 440 is a directional sensor, or substantially unidirectional sensor, configured to receive input from a limited range of directions, or from one direction, respectively. In such an embodiment, optical sensor 440 can include an optical system for improving the ability of optical sensor 440 to differentiate between light sources at a distance. For example, the optical system can include a reflector cone, a light-pipe, a lens, a baffle, or any of these in combination. The optical system increases the signal to noise ratio and the angular resolution of optical sensor 440.

Figure 4B:
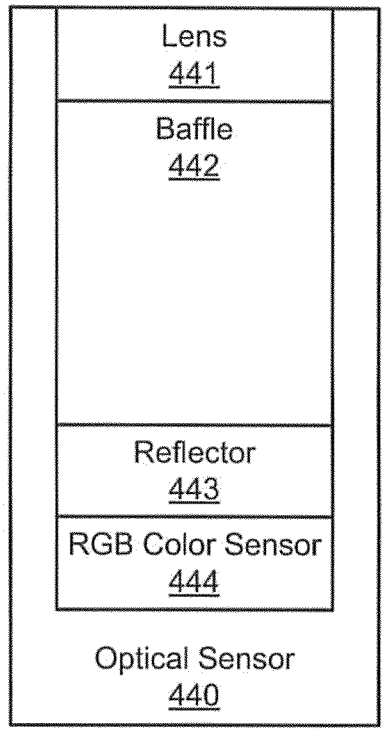
FIG. 4*b* depicts a block diagram of an optical sensor of a controller.
Figure 4C:
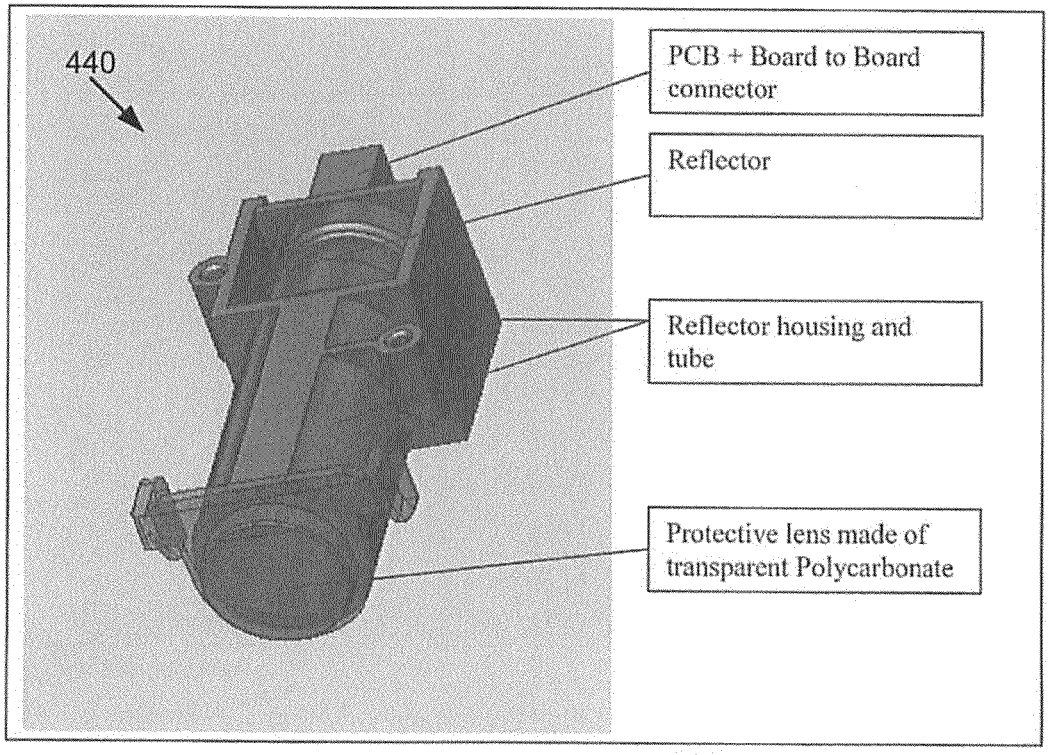
FIG. 4*c* depicts an optical sensor of a controller.

A block diagram of optical sensor 440 is depicted in FIG. 4*b*. As depicted in FIG. 4*b*, optical sensor 440 includes lens 441, baffle 442, reflector 443, and RGB color sensor 444. RGB color sensor 444 can be implemented as, for example, a Taos 3414CS RGB color sensor. Reflector 443 can be implemented as, for example, a Dialight 7 degree reflector. As the length of baffle 442 is increased, the angular discrimination of optical sensor 440 improves. In one embodiment, lens 441 serves only as a protective cover for baffle 442, while in another embodiment lens 441 is curved to focus light. In such a latter embodiment, reflector 443 may be omitted. FIG. 4*c* depicts another view of optical sensor 440 with additional detail.

Controller 430 also includes communicator 436, which in various embodiments includes different kinds of wireless devices. For example, in some embodiments communicator 436 is a radio transmitter for sending radio transmissions, while in other embodiments communicator 436 is a radio transceiver for sending and receiving radio transmissions. Further, communicator 436 can be implemented to operate as, for example, an analog or digital radio, a packet-based radio, an 802.11-standard radio, a Bluetooth radio, or a wireless mesh network radio. Further still, in some embodiments of the invention communicator 436 can be implemented to operate as wireline device, such as a communication-over-powerline device, a USB device, an Ethernet device, or another device for communicating over a wired medium. Communicator 436 can be configured for radio communication with communicator 416 of lighting node 410, as discussed further below.

Controller 430 also includes memory 434, which in various embodiments includes different kinds of memory devices. For example, in some embodiments memory 434 is a volatile memory, while in other embodiments memory 434 is a non-volatile memory. Memory 434 can be implemented as, for example, a random access memory, a sequential access memory, a FLASH memory, or a hard drive, for example.

Controller 430 also includes power supply 431, which in various embodiments includes different kinds of power supply hardware. For example, in some embodiments power supply 431 is a battery power supply, while in other embodiments power supply 431 is coupled to an external power supply. In embodiments wherein power supply 431 is coupled to an external power supply, power supply 431 can include a transformer or other power conditioning device. Power supply 431 provides power to other components of controller 430.

Figure 4D:
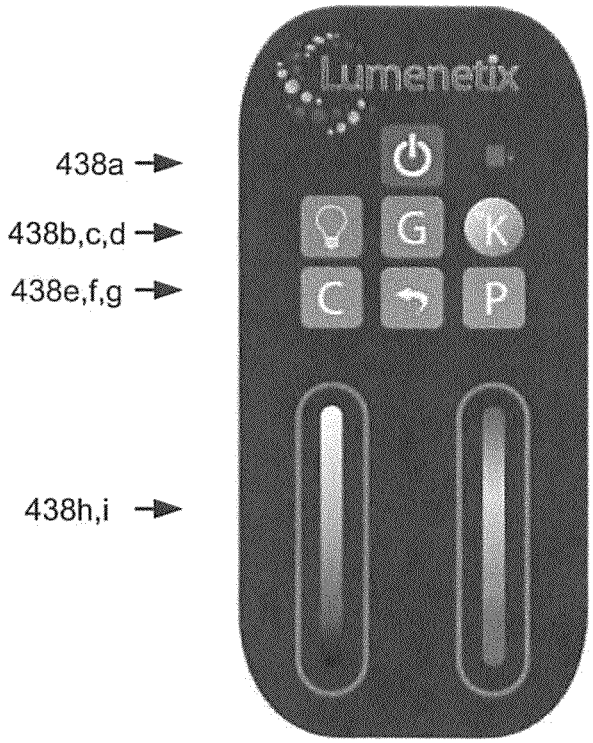
FIG. 4*d* depicts a user interface of a controller.

Controller 430 also includes user interface 438, depicted in FIG. 4*d*. User interface 438 can include, for example, on-off switch 438*a*, a single-function touch wheel (not shown), a multifunction touch wheel (not shown), a touch screen, a keypad, or a capacitive-sensed slider or button, such as brightness slider 438*h* or color slider 438*i*. User interface 438 can control, for example, a dimming function, a color adjustment function, or a warmth adjustment function, for example. User interface 438 can be implemented in various embodiments as a hardware user interface (e.g., a user interface assembled from hardware components) or as a software user interface (e.g., a graphical user interface displayed on a display of controller 430). User interface 438 also includes address button 438*b*, group button 438*c*, preset button 438*d*, copy button 438*e*, back button 438*f*, and paste button 438*g*. The various buttons can be used to control lighting nodes such as lighting node 410.

Controller 430 also includes logic 432. Logic 432 is configured, in one embodiment, as a processor for executing software to control the operation of other components of controller 430. Logic 432 can also be configured as, for example, a hardware controller, an ASIC, or another logic circuit configured according to the techniques introduced here.

In order to maximize battery life controller 430 can automatically enter a power off state after the expiration of a defined idle timeout. Also, controller 430 can transition from the off state to the on state by holding down on-off switch 438*a* for a minimum duration (e.g. 0.5 sec). Address button 438*b* can be utilized to iterate through an address list of lighting nodes. Each address node member can acknowledge its selection by a distinct light flash. Once at the end of the list a wrap to the beginning of the list can occur. By default, in one embodiment the last addressed node can be stored in the remote.

A preset mode of controller 430 triggers the currently addressed node to be set to the reference CCT point (e.g. 3400 K). If desired, the user can reset the previously set CCT value by hitting back button 438*f* which also will exit the preset mode. The preset list can be iterated by hitting preset button 438*d* successively. The step size is can be set to 350 K, and the default range can be 2700 K to 4100 K. All other actions can exit the preset mode. Also, once in preset mode a timeout of 20 seconds can exit the preset mode if no user interface action was executed.

The currently addressed node changes its brightness according to brightness slider 438*h*. The bottom slider position corresponds to fully dimmed, whereas the top slider position corresponds to full brightness. The currently addressed node changes its color according to color slider 438*i*. The bottom slider position corresponds to the warmest color, whereas the top slider position corresponds to the coolest color.

The use of copy button 438*e* and paste button 438*g* for related operations are discussed further below. Group button 438*c* can be used to create groups, for which a group identifier (i.e., a group id) are stored in a lighting node. The way groups are created or modified depends on the currently addressed node. If the addressed node defines a group, the current group id will be used for adding or deleting single nodes. In the other case, the addressed node defines a single node which does not belong to a group, a new group id will be created and assigned to the addressed node. Once in the grouping mode, all nodes part of the addressed group can be switched on, while the remaining nodes in the address list will be switched off. This way the current group members are distinctively highlighted.

Address button 438*b* can be used to iterate through the complete node list, starting with the currently addressed nodes. In the group mode the address button addresses single nodes rather than addressed nodes. Each time a single node is addressed its light output would toggle for enhanced user feedback. By using on-off switch 438*a* existing group members can be deleted from the group. To signal the deletion from the group the light output is switched off. Once a new single node, which is not part of the group, is selected by using address button 438*b*, it can be added to the group by pressing on-off switch 438*a*. To signal the addition to the group the light output is switched on.

To create groups, address button 438*b* can be used to select addressed node. The selection will signal accordingly. Then the user can enter the group mode by hitting group button 438*c*. The addressed node will be highlighted which marks the membership to the current group. The user may then hit address button 438*b* to select a new single node which should be added to the current node and hit on-off switch 438*a* accordingly. Steps can be repeated to add additional nodes.

Controller 430 can be utilized to perform a "copy and paste" lighting operation with lighting node 410. To do so, a user orients controller 430 so that light 460 emitted from light source 405 falls on optical sensor 440. Controller 430 then analyzes light 460 to determine, for example, the CCT of light 460 and the brightness of light 460. This analysis can be performed by analysis routines stored in memory 434 and executed by logic 432. Subsequently, controller 430 uses communicator 436 to transmit the CCT and brightness, in command 462, to lighting node 410 via communicator 416. Command 462 can include, for example, only the CCT and the brightness. Alternatively, command 462 can also include a color mixing plan, an LED model, or both. Having received command 462, lighting node 410 completes the "copy and paste" lighting operation by using information in command 462 to mimic or reproduce light 460 from light source 405 while illuminating region 450. Thus, region 450 is illuminated by lighting node 410 in the same way as it may have been illuminated by light source 405.

Controller 430 can also command lighting node 410 to perform a "light harvesting" lighting operation. To do so, lighting node 410 operates to maintain the combined illuminance of lighting node 410 and light source 405 on region 450. To begin, in one embodiment a user orients controller 430 so that light 460 emitted from light source 405 falls on optical sensor 440. In another embodiment (not shown in FIG. 4*a*), a user orients controller 430 so that light from region 450 falls on optical sensor 440. Controller 430 then analyzes the light to determine, for example, the CCT and brightness of the light at a particular starting time. This analysis can be performed by analysis routines stored in memory 434 and executed by logic 432. Subsequently, the combined illuminance at the starting time will be maintained. To do so, controller 430 uses communicator 436 to transmit the CCT and brightness at the starting time, in command 462, to lighting node 410 via communicator 416. Command 462 can include, for example, only the CCT and the brightness. Alternatively, command 462 can also include a color mixing plan, an LED model, or both. Having received command 462, lighting node 410 performs the "light harvesting" lighting operation by observing light source 405 with sensor 418, or by observing region 450 with sensor 418. As such, sensor 418 includes an optical sensor in a manner similar to optical sensor 440. As the light output of light source 405 varies after the starting time, lighting node 410 varies oppositely to maintain the combined illuminance at region 450. Thus, for example, if the CCT or brightness of light source 405 cools or declines, respectively, then the CCT or brightness of light source 420 will be warmed or increased. In this way, region 450 receives a substantially constant combined illuminance.

Controller 430 can also command lighting node 410 to perform a "light following" lighting operation. To do so, lighting node 410 operates to mimic the output of light source 405 on region 450 over time. To begin, controller 430 uses communicator 436 to transmit light following command 462 to lighting node 410 via communicator 416. Having received light following command 462, lighting node 410 observes light source 405 with sensor 418. As such, sensor 418 includes an optical sensor in a manner similar to optical sensor 440. As the light output of light source 405 varies, lighting node 410 varies in the same way, thereby following light source 405. Thus, for example, if the CCT or brightness of light source 405 cools or declines, respectively, then the CCT or brightness of light source 420 will similarly cool or decline.

Figure 5:
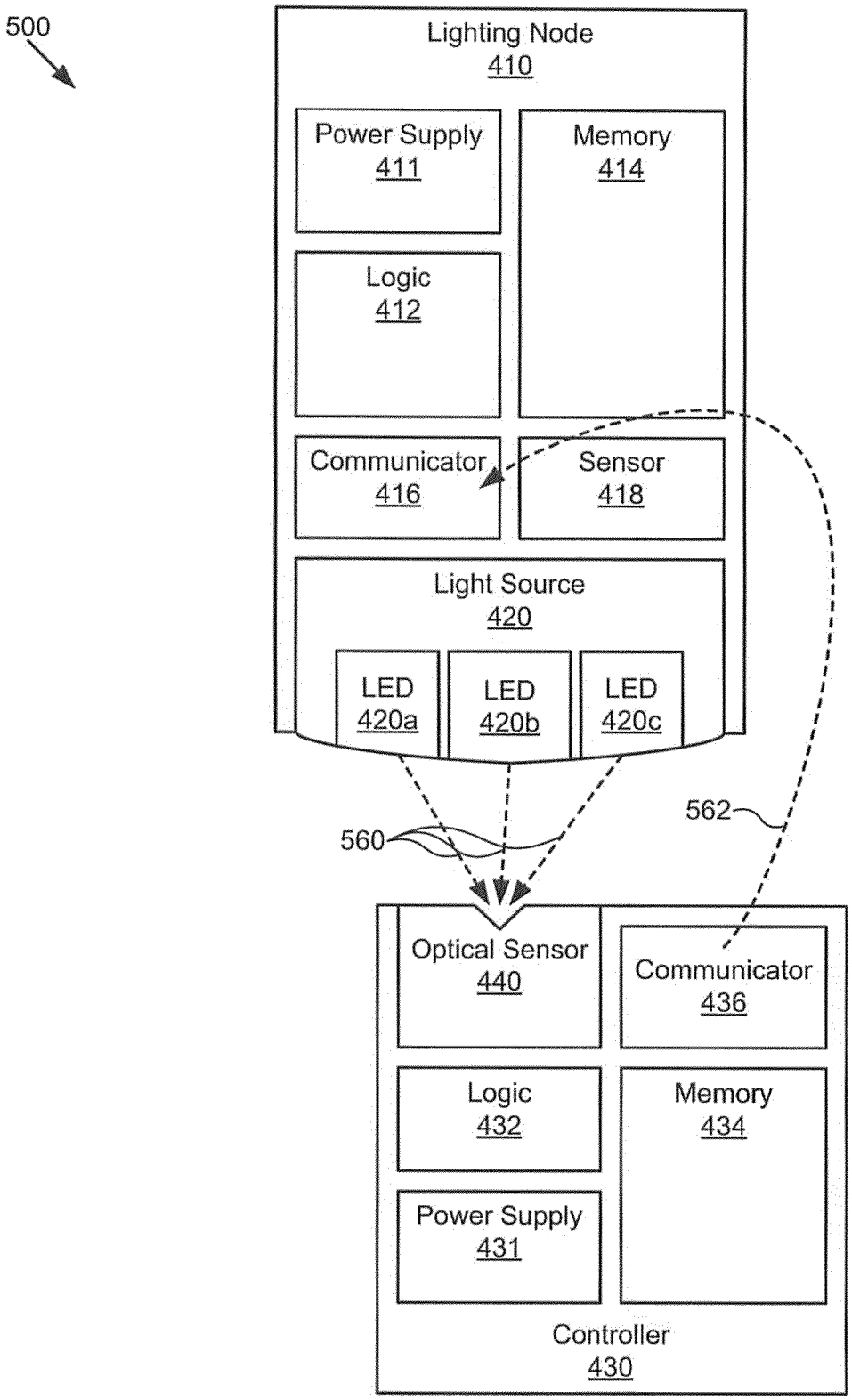
FIG. 5 depicts a block diagram of a lighting node and a controller.

FIG. 5 depicts system 500, which includes lighting node 410 and controller 430 of FIG. 4*a*. In system 500, a calibration operation of lighting node 410 is depicted. It is the case that during the course of long operation, the light output of light source 420 may change over time, such as by changing brightness or changing color. The change can typically be a variation of several percent over ten thousand hours of operation, for example, for LEDs. Because of this change, the color mixing plan in lighting node 410 can require adjustment. Thus, in one embodiment a user can orient controller 430 so that light 560 emitted from LEDs 420*a*, 420*b*, and 420*c* falls on optical sensor 440. Controller 430 then analyzes light 560 to determine, for example, the CCT and brightness of the light. This analysis can be performed by analysis routines stored in memory 434 and executed by logic 432. The result of the analysis can be compared to a color mixing plan for lighting node 410 stored in controller 430. If light 560 does not conform to the color mixing plan in controller 430, then controller 430 can correct the stored color mixing plan and transmit it via communicator 436 to lighting node 410 via communicator 416 via command 562. Controller 430 can correct the stored color mixing plan by, for example, minimizing the CCT error in light 560 at one point by adjusting a constant term in a polynomial in the color mixing plan.

Figure 6:
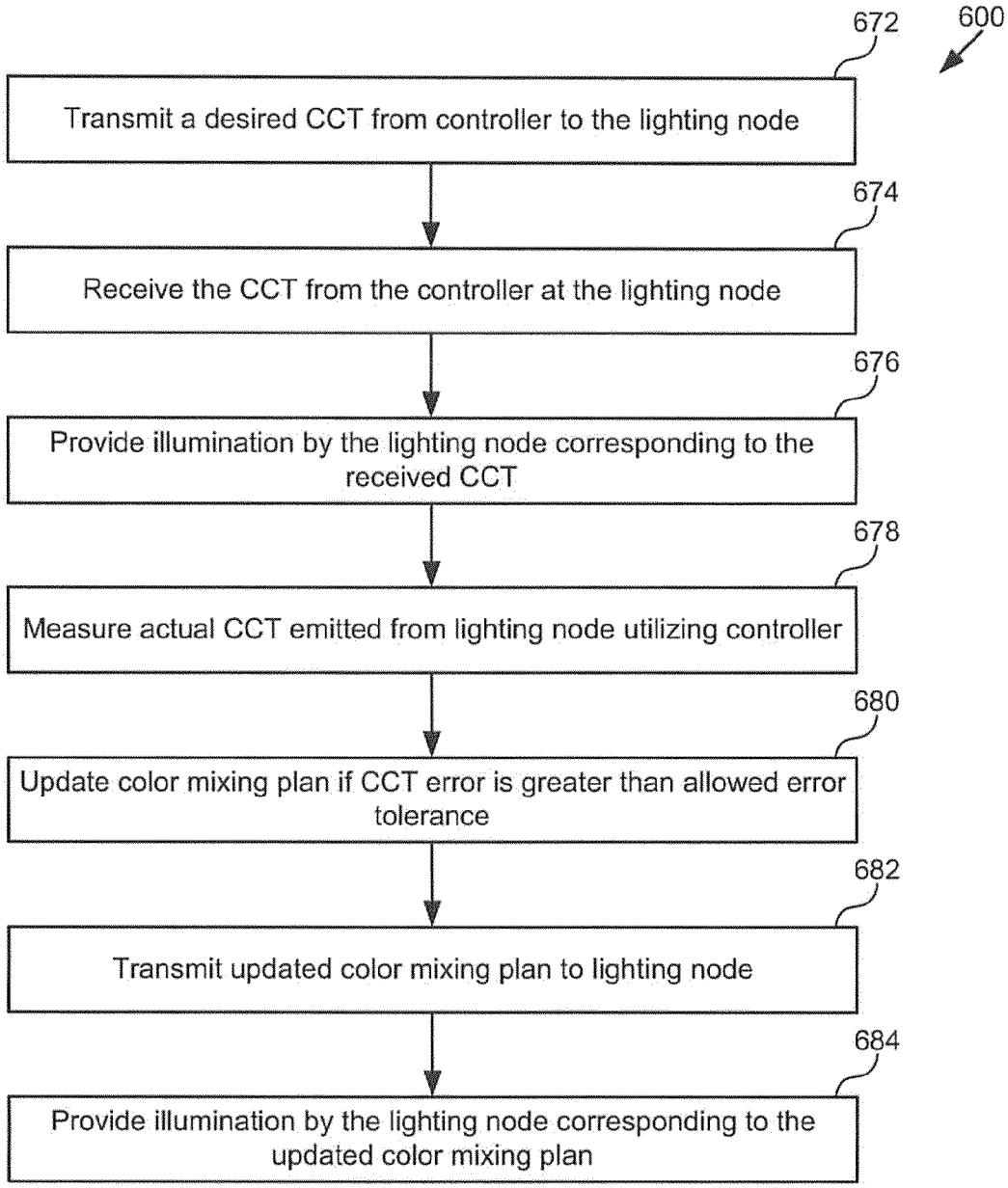
FIG. 6 depicts a flowchart of a method for updating a color mixing plan utilizing a controller.

FIG. 6 depicts flowchart 600, which includes steps 672 through 684 for performing a method for calibration, such as the calibration discussed above with respect to FIG. 5. In particular, the steps include transmitting a desired CCT from a controller to the lighting node, receiving the CCT from the controller at the lighting node, and providing illumination by the lighting node corresponding to the received CCT. Further, the steps include measuring the actual CCT emitted from the lighting node utilizing the controller, updating the color mixing plan if the CCT error is greater than an allowed error tolerance, transmitting an updated color mixing plan to the lighting node, and providing illumination by the lighting node corresponding to the updated color mixing plan.

Figure 7:
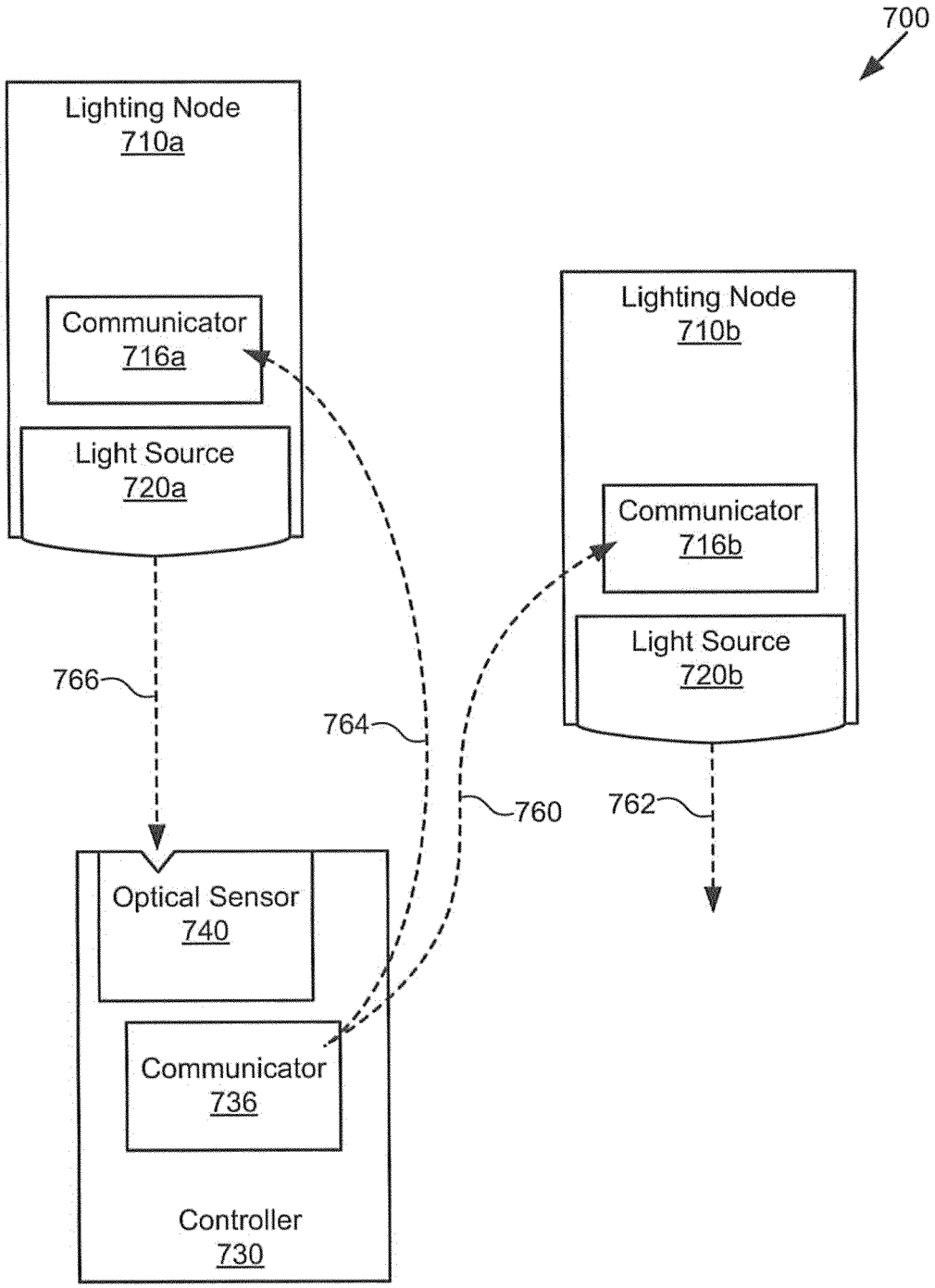
FIG. 7 depicts a block diagram of a controller and two lighting nodes.

As depicted in FIG. 7, a user can utilize controller 730 to identify, for example, lighting node 710*a* utilizing an individual node identification query method. In FIG. 7, lighting nodes 710*a* and 710*b* each correspond, in one embodiment, to lighting node 410 in FIG. 4*a*. In FIG. 7 some components of lighting nodes 710*a* and 710*b* have been omitted for illustrative purposes. The individual node identification query method discussed below includes transmitting, by controller 730, a sequence of identification queries to a group of lighting nodes (e.g. lighting nodes 710*a* and 710*b*) via a communicator channel, e.g. utilizing communicators 736, 716*a*, and 716*b*. The group of lighting nodes each contains an identifier (such as a serial number, for example) stored in a memory, and controller 730 contains a list of those identifiers. As controller 730 transmits each identification query, controller 730 checks for an acknowledgement response from a particular lighting node modulated by that lighting node's light source, i.e. via a lamp channel of that lighting node.

Figure 8A:
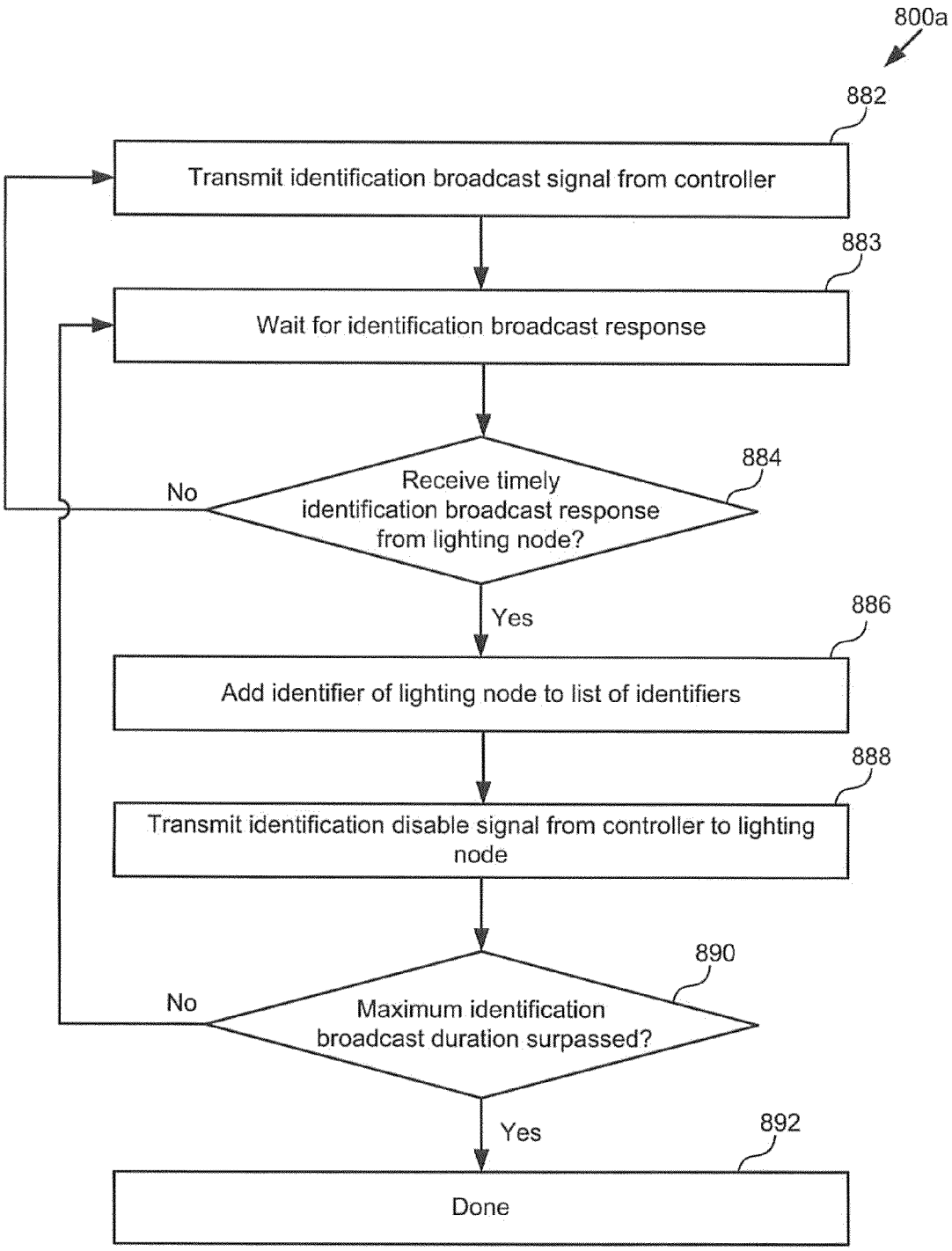
FIG. 8*a* depicts a flowchart of an identification broadcast method.

To begin the individual node identification query method, controller 730 should contain a list of identifiers of lighting nodes. Controller 730 can acquire a list of identifiers of lighting nodes by, in one embodiment, being preprogrammed with the list. In another embodiment, controller 730 can acquire a list of identifiers via an identification broadcast method, such as that depicted in flowchart 800*a* in FIG. 8*a*. Flowchart 800*a* includes transmitting an identification broadcast signal from controller 730, waiting for an identification broadcast response, and checking to see if a timely identification broadcast response from a lighting node is received. If no timely response is received, flowchart 800*a* repeats from the beginning. If a timely response is received, then flowchart 800*a* proceeds to add the identifier of the lighting node to a list of identifiers, and to transmit an identification disable signal to the lighting node (the lighting node is then prevented from immediately re-transmitting another identification broadcast response after a subsequent identification broadcast signal from the controller). Next, flowchart 800*a* checks to see if the maximum identification broadcast duration has been surpassed. If not, then flowchart 800*a* resumes waiting for an additional identification broadcast response from another lighting node. However, if so, then flowchart 800*a* is done.

Having described how controller 730 acquires a list of identifiers, discussion now returns to FIG. 7. To begin performing the individual node identification query method, the user orients controller 730 at lighting node 710*a*. By doing so, optical sensor 740 is aligned to light source 720*a* of lighting node 710*a*. In one embodiment optical sensor 740 is a directional sensor, or substantially unidirectional sensor, configured to receive input from a narrow range of directions, or from one direction, respectively. Therefore, by orienting controller 730 at lighting node 710*a*, light subsequently emitted by light source 720*a* can reach optical sensor 740, but light subsequently emitted by light source 720*b* of lighting node 710*b*, for example, cannot.

While oriented at lighting node 710*a*, controller 730 can transmit identification query 760 from communicator 736. Identification query 760 is in one embodiment a substantially omnidirectional radio broadcast that is received by both of lighting nodes 710*a* and 710*b*, but that includes an identifier only of, for example, lighting node 710*b* (e.g., identification query 760 is addressed to only lighting node 710*b*). After receiving identification query 760, lighting node 710*b* replies by transmitting acknowledgement response 762 via light source 720*b* (if lighting node 710*a* also receives identification query 760, lighting node 710*a* takes no action because identification query 760 is not addressed to lighting node 710*a*). Acknowledgement response 762 is, in one embodiment, a brief variation in the output of light source 720*b*. Further, acknowledgement response 762 in one embodiment contains only enough information to convey the fact that identification query 760 was received, rather than enough information to uniquely identify lighting node 710*b*, for example.

Notably, lighting node 710*b* transmits acknowledgement response 762 regardless of whether the respective LEDs of light source 720*b* are contemporaneously operating to provide illumination or not. For example, lighting node 710*b* can be unused for illumination when identification query 760 received, and thus light source 720*b* will be turned off. In such a circumstance, lighting node 710*b* can transmit acknowledgement response 762 by, for example, modulating light source 720*b* into an on state briefly. Further, light source 720*b* can be modulated into an on state in a manner that is imperceptible to a human observer, but is detectable by an optical sensor oriented toward lighting node 710*b* (e.g., a modulation lasting less than one second and involving increasing the brightness from zero to ten percent of total). In an alternate circumstance, lighting node 710*b* can be providing illumination when identification query 760 is received, and thus light source 720*b* will be turned on. In such a circumstance, lighting node 710*b* can transmit acknowledgement response 762 by, for example, modulating light source 720*b* into an off state briefly. Further, light source 720*b* can be modulated into an off state in a manner that is imperceptible to a human observer, but is detectable by a optical sensor oriented toward lighting node 710*b*.

As depicted in FIG. 7, controller 730 is not oriented at lighting node 710*b*. Optical sensor 740 therefore does not receive acknowledgement response 762, or receives acknowledgement response 762 only very weakly. Thus, controller 730 can store a record indicating the absence of the response, or of the weakness of the response. Controller 730 next transmits identification query 764 from communicator 736. Identification query 764 is, in one embodiment, substantially the same as identification query 760, except that it includes an identifier only of lighting node 710*a*. After receiving identification query 764, lighting node 710*a* replies by transmitting acknowledgement response 766 via light source 720*a*. Acknowledgement response 766 is, in one embodiment, a brief variation in the output of light source 720*a*, in the manner of acknowledgement response 762 discussed above. Because controller 730 is oriented toward lighting node 710*a*, optical sensor 740 therefore does receive acknowledgement response 766. Controller 730 then determines, by comparing the responses received after each of identification query 760 and 764, that lighting node 710*a* is the lighting node controller 730 is oriented toward.

After controller 730 determines that lighting node 710*a* is the lighting node controller 730 is oriented toward, controller 730 can give the user visual feedback of the determination. To do so, in one embodiment controller 730 transmits a positive identification command to lighting node 710*a* in a manner similar to identification query 764. Upon receiving the positive identification command, lighting node 710*a* performs a positive identification response by, for example, varying illumination output in a manner perceptible to a human observer (in contrast, as stated above, the earlier acknowledgement response 766 was not perceptible to a human observer). In this way, the user of controller 730 has visual feedback from lighting node 710*a* of the determination made by controller 730.

Figure 8B:
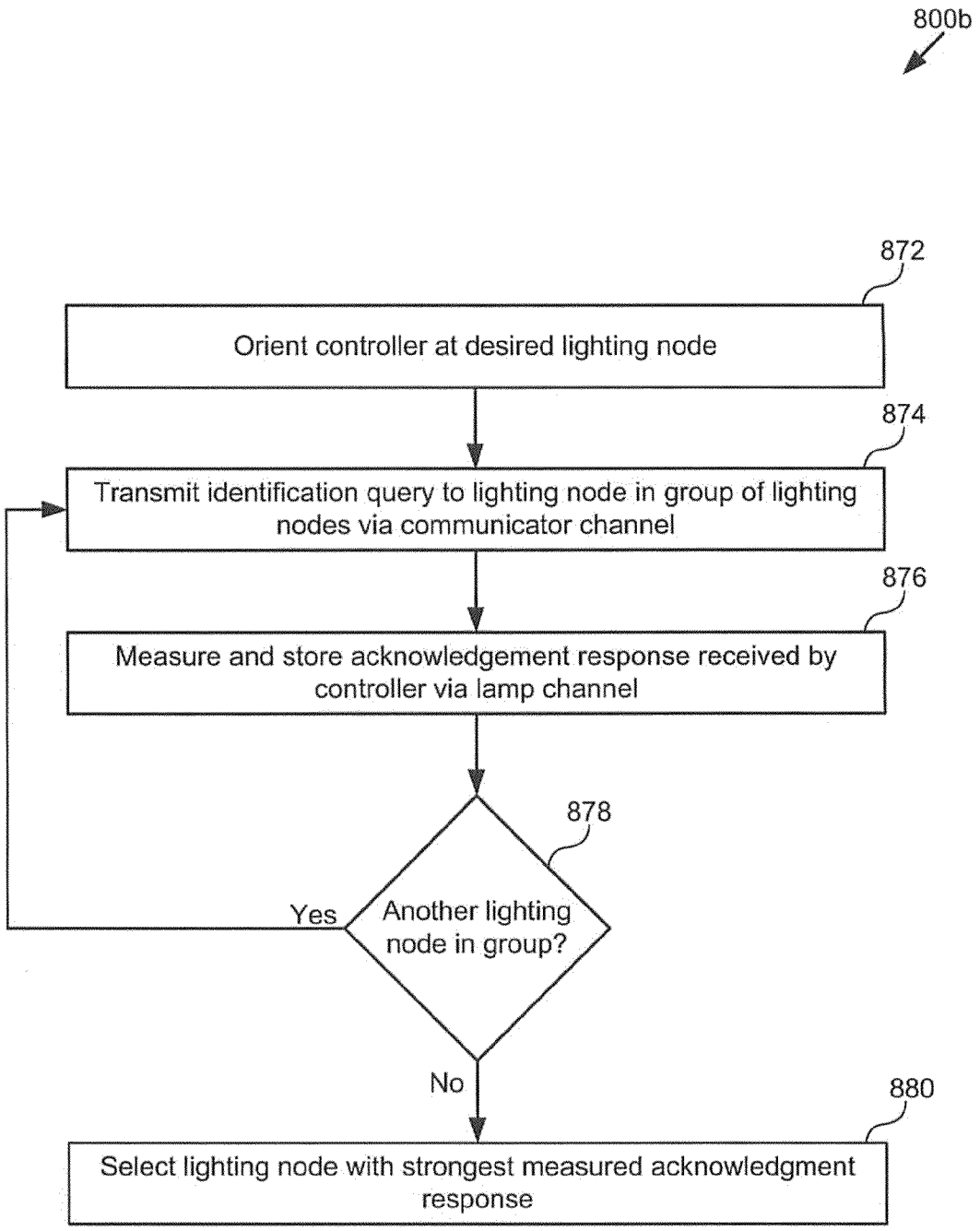
FIG. 8*b* depicts a flowchart for performing an individual node identification query method

FIG. 8*b* depicts flowchart 800*b* of an individual node identification query method. The method includes orienting a controller at desired a lighting node and transmitting an identification query to a lighting node (e.g. lighting node 710*b* in FIG. 7) in a group of lighting nodes in a communicator channel. The method further includes measuring an acknowledgement response received by the controller (using, e.g., an optical sensor) in a lamp channel, or simply noting that no acknowledgement response is received. After such measuring or noting; the result can be stored in the controller for later evaluation. The method continues by deciding whether there is another lighting node remaining in the group (e.g., lighting node 710*a* in FIG. 7). If there is, flowchart 800*b* repeats utilizing the remaining nodes. If not (e.g., after both lighting nodes 710*b* and 710*a* have been queried), flowchart 800*b* continues by selecting from the stored results the lighting node with the strongest measured acknowledgement response, or by selecting the lighting node that notably responded.

The words "herein," "above," "below," and words of similar import, when used in this application, shall refer to this application as a whole and not to any particular portions of this application. Where the context permits, words in the above Detailed Description using the singular or plural number can also include the plural or singular number respectively. The word "or," in reference to a list of two or more items, covers all of the following interpretations of the word: any of the items in the list, all of the items in the list, and any combination of the items in the list.

The foregoing description of various embodiments of the claimed subject matter has been provided for the purposes of illustration and description. It is not intended to be exhaustive or to limit the claimed subject matter to the precise forms disclosed. Many modifications and variations will be apparent to the practitioner skilled in the art. Embodiments were chosen and described in order to best describe the principles of the invention and its practical application, thereby enabling others skilled in the relevant art to understand the claimed subject matter, the various embodiments and with various modifications that are suited to the particular use contemplated.

The teachings of the invention provided herein can be applied to other systems, not necessarily the system described above. The elements and acts of the various embodiments described above can be combined to provide further embodiments.

While the above description describes certain embodiments of the invention, and describes the best mode contemplated, no matter how detailed the above appears in text, the invention can be practiced in many ways. Details of the system can vary considerably in its implementation details, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

What is claimed is:

1. A method for color matching an output of a lighting node comprising a plurality of lamps, the method comprising:

receiving at the lighting node a correlated color temperature setting;

determining at the lighting node a temperature of the lighting node-utilizing a temperature sensor of the lighting node;

determining in the lighting node a luminous flux of a plurality of lamps of the lighting node required to output the received correlated color temperature from the lighting node based on a color mixing plan;

determining in the lighting node a current required by each of the plurality of lamps based on the luminous flux, the temperature, and a function for the current used to generate a given luminous flux over a range of luminous flux values and temperatures for each of the plurality of lamps, wherein the function for the current is modeled individually for each of the plurality of lamps; and operating the plurality of lamps with the determined current.

2. The method of claim 1, further including receiving a brightness setting, wherein determining the luminous flux is further based on the received brightness setting.

3. The method of claim 1, further including determining in the lighting node duty cycle control required to deliver the required current to each of the plurality of lamps, and the plurality of lamps are operated with the required current and duty cycle control.

4. The method of claim 1, further comprising re-determining the current required by each of the plurality of lamps when the measured temperature changes.

5. The method of claim 1, wherein measuring a temperature of the lighting node comprises measuring a temperature of the lighting node at each of the plurality of lamps.

6. The method of claim 1, further comprising reducing the determined luminous flux of the plurality of lamps to prevent the temperature of the lighting node from exceeding a maximum operating temperature.

7. The method of claim 1, wherein the color mixing plan includes a look-up table of points on curves of luminous flux as a function of correlated color temperature.

8. The method of claim 1, wherein the color mixing plan includes a functional approximation set of coefficients.

9. The method of claim 1, wherein the plurality of lamps each include one or more light emitting diodes (LEDs).

10. A lighting node comprising:

a plurality of lamps;

a temperature sensor;

a memory;

a logic, wherein the logic is configured to:

determine a temperature at the lighting node utilizing the temperature sensor;

determine a luminous flux of the plurality of lamps required to output a correlated color temperature from the lighting node based on a color mixing plan stored in the memory;

determine a current required by each of the plurality of lamps based on the luminous flux, the determined temperature, and a generated model for each of the plurality of lamps, wherein the generated model includes a function for the current used to generate a luminous flux over a range of luminous flux values and temperatures; and activate the plurality of lamps at the determined current.

11. The lighting node of claim 10, wherein the logic is further configured to determine duty cycles required to deliver the required current to each of the plurality of lamps, and the plurality of lamps are operated at the determined duty cycles.

12. The lighting node of claim 10, wherein the logic is further configured to throttle the luminous flux of the plurality of lamps if the temperature of the plurality of lamps equals or exceeds a maximum operating temperature.

13. The lighting node of claim 10, wherein the logic is further configured to determine a luminous flux of the plurality of lamps to output the correlated color temperature based on a received brightness target for the lighting node.

14. The lighting node of claim 10, wherein the temperature sensor senses a temperature of two or more of the plurality of lamps.

15. The lighting node of claim 10, further comprising a receiver configured to receive the correlated color temperature.

16. The lighting node of claim 15, wherein the receiver receives the correlated color temperature wirelessly.

17. The lighting node of claim 15, wherein the receiver is a wireline device.

18. The lighting node of claim 10, wherein each of the plurality of lamps includes one or more light emitting diodes (LED), and wherein the memory further stores the generated models for each LED in the plurality of lamps.

* * * * *